US006200233B1

(12) United States Patent
Moody

(10) Patent No.: US 6,200,233 B1
(45) Date of Patent: Mar. 13, 2001

(54) GOLF TEE AND METHODS OF MAKING THE SAME

(76) Inventor: Timothy P. Moody, 450 S. Villa Rose Ave., Springfield, MO (US) 65802

( * ) Notice: Subject to any disclaimer, the term of this patent is extended or adjusted under 35 U.S.C. 154(b) by 0 days.

(21) Appl. No.: 09/487,092

(22) Filed: Jan. 19, 2000

Related U.S. Application Data

(63) Continuation of application No. 09/057,118, filed on Apr. 8, 1998, now abandoned.

(51) Int. Cl.[7] ..... A63B 57/00
(52) U.S. Cl. ..... 473/398; 473/387
(58) Field of Search ..... 473/387–403

(56) References Cited

U.S. PATENT DOCUMENTS

| | | | | |
|---|---|---|---|---|
| D. 367,092 | | 2/1996 | Gustine . | |
| 648,956 | * | 5/1900 | Herrick | 473/387 |
| 654,666 | * | 7/1900 | Newton | 473/394 |
| 1,564,212 | * | 12/1925 | Decker | 473/390 |
| 1,617,232 | * | 2/1927 | Butler et al. | 473/392 |
| 2,159,893 | * | 5/1939 | Hansen | 473/393 |
| 2,805,071 | * | 9/1957 | Kaplan | 473/398 |
| 3,645,537 | | 2/1972 | Parenteau . | |
| 4,181,300 | | 1/1980 | Bradley . | |
| 4,905,999 | | 3/1990 | Voinovich et al. . | |
| 4,998,732 | | 3/1991 | Gallant . | |
| 5,052,689 | | 10/1991 | Lettrich . | |
| 5,221,090 | | 6/1993 | Hong . | |
| 5,242,161 | | 9/1993 | Wilkerson . | |
| 5,571,055 | * | 11/1996 | Lewis et al. | 473/398 |
| 5,672,122 | * | 9/1997 | Strong | 473/398 |
| 5,679,081 | | 10/1997 | Santilli . | |
| 6,110,060 | * | 8/2000 | Spoto | 473/398 |

* cited by examiner

*Primary Examiner*—Steven Wong
(74) *Attorney, Agent, or Firm*—Richard L. Marsh

(57) ABSTRACT

A hollow, rubber unitary golf tee is adapted to be placed upon a playing surface, the golf tee comprising a frusto-conical portion, a playing surface engaging base, an upper surface and a centrally located ball support associated with the upper surface wherein the playing surface engaging base is greater in diameter than the upper surface.

15 Claims, 2 Drawing Sheets

FIG. 2
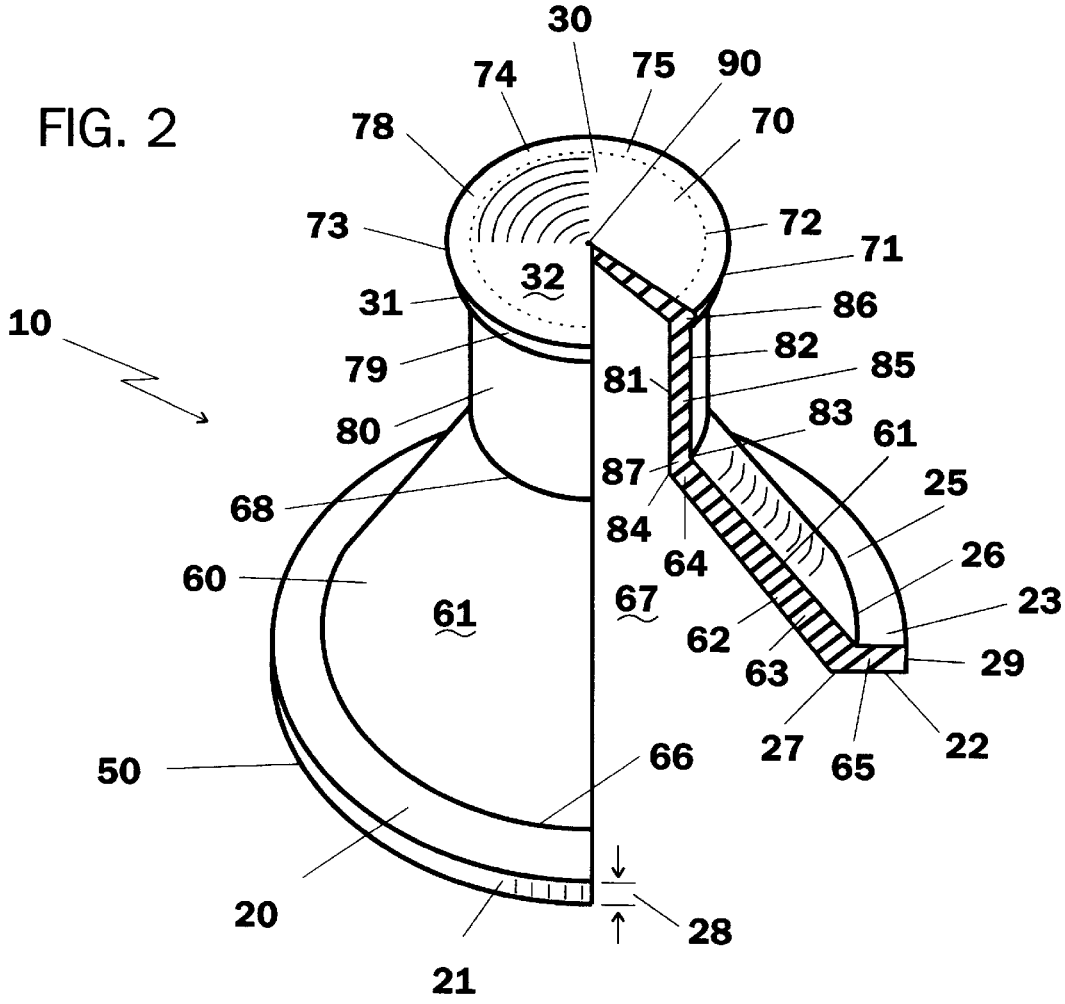
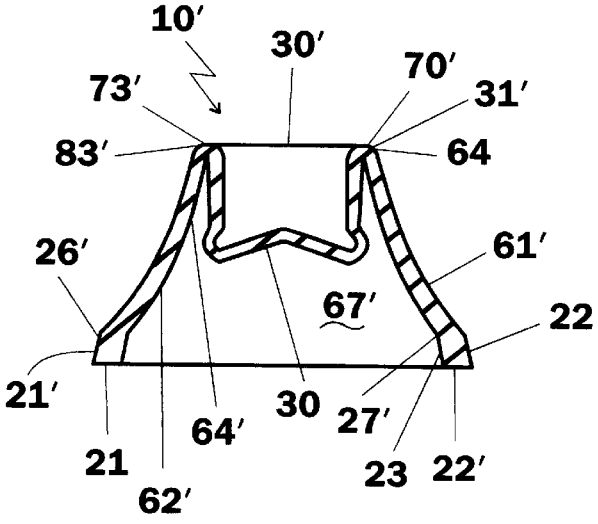
FIG. 5

GOLF TEE AND METHODS OF MAKING THE SAME

This application is a continuing application of Applicant's parent patent application Ser. No. 09/057,118 filed on Apr. 8, 1998, now abandoned.

BACKGROUND OF THE INVENTION

1. Field of the Invention

This invention relates to golf tees. In particular, this invention relates to a unitary golf tee adapted to be placed upon a playing surface, the golf tee comprising a frusto-conical portion, a playing surface engaging base, an upper surface and a centrally located ball support associated with the upper surface wherein the playing surface engaging base is greater in diameter than the upper surface.

2. Prior Art Statement

A golf tee having a spike point at one end and a ball receiving recess at the other end is commonly used for teeing up a golf ball on a tee box in the game of golf. Such tees are typically made of wood or thermoplastic material and are often broken when struck with a club in the process of driving the ball from the tee. Rather than pick up the pieces and discard them in a suitable receptacle, golfers usually let the broken parts, and some times whole tees, lie where driven by the club. Those familiar with the game of golf will readily appreciate that the parts of these broken tees are scattered about the tee box and for some distance therebeyond. As such, the parts are left to become thrown about still further in the regular maintenance process of mowing the tee box and the immediate surrounding area and are therefore left to biodegrade, a process which takes years for the wooden tees and decades for the thermoplastic tees. Since a golfer needs a tee every time when teeing from the tee box and the process to teeing off results in a broken or lost tee every other or every third hole, the broken or lost tees must be replaced often resulting in an additional expense to the golfer and additional debris added to the course. It is readily apparent therefore that a need exists for a durable, ecologically friendly, golf ball tee which will be picked up by the golfer each time, recycling same for use on every hole thereby contributing to a cleaner golf course while contributing as well to the wise use of the earth's resources.

Additionally, many golf courses now prohibit the use of spiked golf shoes because of wear and tear on greens as well as potential damage to tee boxes. Still, holes may be found in the tee box due to the use of conventional spike tees. Since spike less golf shoes are now required, the need for a durable, recyclable, spike less golf tee becomes apparent.

Furthermore, when forcing a spike tee into the ground, although the golfer is careful, the spike tee is still subject to tilting and therefore does not place the ball receiving socket in a parallel relationship to the playing surface. This may cause the ball to be driven incorrectly resulting in a lower score for the golfer. On some courses, it is difficult to push a spike tee into ground as the tee box surface is hard. This is especially true in hot, dry weather or climates when the tee box surface has become dried out from lack of moisture. Some golf tees have been broken by merely trying to insert them into a dry tee box surface. It is readily apparent therefore, that a golf tee which may be placed upon the surface instead of pushing same into the playing surface is sorely needed.

Even when conditions are ideal on the tee box surface, it is still difficult to achieve an accurate, consistent height placement for the ball often times from one tee box to another tee box. This may cause inconsistent driving from the tee boxes resulting in a lower score. Furthermore, a spike tee cannot be used on a flat mat, such as used at a driving range, or indoors for practice driving into a net. A golf tee which can be placed upon a flat surface without penetrating the surface is needed.

Finally, when using clubs of different lengths, a spike tee must be inserted to a different depth for different club lengths which is difficult to do for many of the above reasons. Therefore, a set of golf tees, each of unitary construction but differing heights is needed for the golfer to select for each of the groups of clubs, particularly a set of three tees one each for the long woods, the short woods/long irons and the short irons.

It is known to provide a permanent golf tee comprising a horizontal flexible disc with a ball receiving recess in the top surface; a spongy vertical cylinder having the disc secured to its top end; a downwardly and inwardly extending tapered flexible section secured to the cylinder; and an inverted rigid elongated spike cone having its base imbedded in the section and extending downwardly therefrom. For instance, see the U.S. Pat. No. 3,645,537 issued on Feb. 9, 1972 to Leo R. Parenteau or the U.S. Design Pat. No. 367,092 issued on Feb. 13, 1996 to Floyd L. Gustine.

It is also known to provide a golf ball tee comprising a first horizontal support and a second horizontal support normally connected to the first horizontal support to provide a "T" shaped structure; a downwardly extending leg from outboard ends of the supports combining to operably form a stable three point bearing contact with a ground surface, the "T" shaped structure having a solid right cylindrical golf ball supporting stanchion integrally fashioned with the horizontal supports and projecting above a surface plane thereof. For instance, see the U.S. Pat. No. 4,181,300 issued Jan. 1, 1980 to Arthur S. Bradley.

It is further known to provide a practice golf tee system adapted to be temporarily anchored into the ground comprising an elongate flexible tubular member affixed to an threaded elongated anchor, the upper end of the anchor having a tool access adapted to be engaged by an elongated handle means for inserting the anchor into the ground. For instance, see U.S. Pat. No. 4,905,999 issued on Mar. 6, 1990 to Vionovich, et al.

It is also known to provide a golf ball tee for supporting a golf ball at a predetermined height above a playing surface comprising a vertically tapered cylindrical ball support having an outwardly and downwardly extending flange at its lower end, an elongated ground engaging spike having a planar disc at its upper end, a retainer ring engaging the downwardly extending flange folded around the edges of the flange and the disc shaped member to thereby rigidly connect the support shaft to the ground engaging spike. For instance, see the U.S. Pat. No. 4,998,732 issued Mar. 12, 1991 to Thomas M. Gallant.

Additionally, it is known to provide a golf tee having a cylindrical shank pointed at one end and diverging conically into a golf ball support head at the opposite end and a support for use in cooperation therewith to support a ball at a predetermined distance above the ground, the support comprising an annual base member adapted to rest on the ground and a tubular member of less diameter than the base member adapted to surround the cylindrical shank. The tubular member may have removable elements for adjusting the height thereof. For instance see the U.S. Patent No. 5,052,689 issued on Oct. 1, 1991 to Kenneth P. Lettrich or the U.S. Pat. No. 5,242,161 issued on Sep. 7, 1993 to W. K. Wilkerson.

It is still further known to provide a combination long golf tee and short golf tee comprising a cylindrical tee member having inner and outer surfaces and an apertured stop plate at a predetermined portion of the inner surface thereof to form a recess therein, and an elongated spike tee member having a head part and a leg part, the head part being detachably fitted in to the recess. For instance, see the U.S. Pat. No. 5,221,090 issued on Jun. 22, 1993 to Bum K. Hong.

Finally, it is known to provide an adjustable height ball tee comprising a tapered body defined by plurality of separable, frangible sections of different size but the same shape, the tapered body having an upper end configured to support a ball, a lower end larger than the upper end and means on one surface of a base configured to penetrate a support surface. For instance, see the U.S. Pat. No. 5,679,081 issued on Oct. 21, 1997 to Robert Santilli.

SUMMARY OF THE INVENTION

It is an object of this invention to provide a flexible hollow rubber golf ball support adapted to be used as a golf ball tee, the support having a frustoconical base and a cylindrical upper portion terminating in an inwardly formed depression for placement of a golf ball thereupon.

It is another object of this invention to provide distinct, separate sized golf ball supports for teeing a golf ball at different heights, each support of one piece construction and each having a ball support associated therewith.

It is yet another object of this invention to provide a unitary golf tee adapted to be placed upon a playing surface, the golf tee comprising a frustoconical portion, a playing surface engaging base, an upper surface and a centrally located ball support associated with the upper surface wherein the playing surface engaging base is greater in diameter than the upper surface.

Still another object of this invention is to provide a unitary golf tee adapted to be placed upon a playing surface, the golf tee comprising a frustoconical portion, a playing surface engaging base, an upper surface and a centrally located ball support associated with the upper surface wherein the playing surface engaging base is substantially greater in diameter than the upper surface.

Yet another object of this invention is to provide a unitary golf tee formed of an elastomeric material having pigmentation fully incorporated therein contrasting with the playing surface to prevent discoloration of a golf club face when the tee and a ball supported on the tee are struck with a golf club head.

It is a further object of this invention to provide a golf tee that is hollow in order that it may be placed upon a playing surface, rotated slightly to remove any foreign material from under an annular base such that the golf tee may rest firmly upon the playing surface.

Additionally, another object to this invention is to provide a unitary golf tee formed of rubber having a durometer from about 45 to about 65 Shore A points.

Those skilled in the art will appreciate that it is another object of this invention to provide a unitary golf tee having a frustoconical base that has a base plane, an upper surface plane and tapering sides, wherein the base plane is contiguous with an upper surface of an annular base and the tapering sides slope from the base plane upwardly to the upper surface plane.

Again, an object of this invention is to provide a unitary golf tee that has a ball support spaced above an upper surface plane of a frustoconical portion and may further have a cylindrical portion extending upwardly from the upper surface plane terminating in the ball support.

Again, another object of this invention is to provide a unitary golf tee that has a ball support spaced above an upper surface plane of a frustoconical portion wherein the ball support is contiguous with and comprises the upper surface plane.

It is yet another object of this invention to provide an unitary golf tee having an upper surface comprising an annular planar flange which supports a ball upon a ball support in substantially circular line contact and wherein the ball support may further comprise an inwardly projecting conical or spherical surface depending from the annular flange.

Yet another object of this invention is to provide an unitary, hollow golf tee wherein the ball support may be depressed downwardly into the hollow tee, the tee becoming inverted to provide a new playing surface engaging base, a new upper surface and a new centrally located ball support associated with the new upper surface wherein the new playing surface engaging base is greater in diameter than the new upper surface.

It is yet another object of this invention to provide a method of making an unitary golf tee comprising the steps of forming a playing surface engaging base comprising an annular flange, forming a frustoconical portion above the annular flange, the frustoconical portion having an upper surface and forming a centrally located ball support associated with the upper surface.

Finally, it is an object of this invention to provide a golf tee for use upon a playing surface in combination with a ball to be supported by the golf tee, the golf tee comprising a frustoconical portion, a playing surface engaging base, an upper surface and a centrally located ball support associated with the upper surface wherein the playing surface engaging base is greater in diameter than the upper surface and wherein the ball is adapted to be engaged by the ball support and wherein the playing surface engaging base and the ball support are parallel whereby the ball support is adapted to always be parallel to the playing surface.

BRIEF DESCRIPTION OF THE DRAWINGS

FIG. 2 is a greatly enlarged perspective view of the preferred embodiment of a golf tee for use with the long woods having a portion cut away to show the internal configuration.

FIG. 5 is a cross section view of the golf tee of FIG. 3 turned inside out for providing an intermediate height between the golf tee of FIG. 3 and FIG. 4.

DESCRIPTION OF THE PREFERRED EMBODIMENTS

While the various features of this invention are hereinafter described and illustrated as a golf tee and means to utilize same in the game of golf, is to be understood that the invention can be used for a variety of uses as may become apparent to the user and as hereinafter described.

Figure 1:
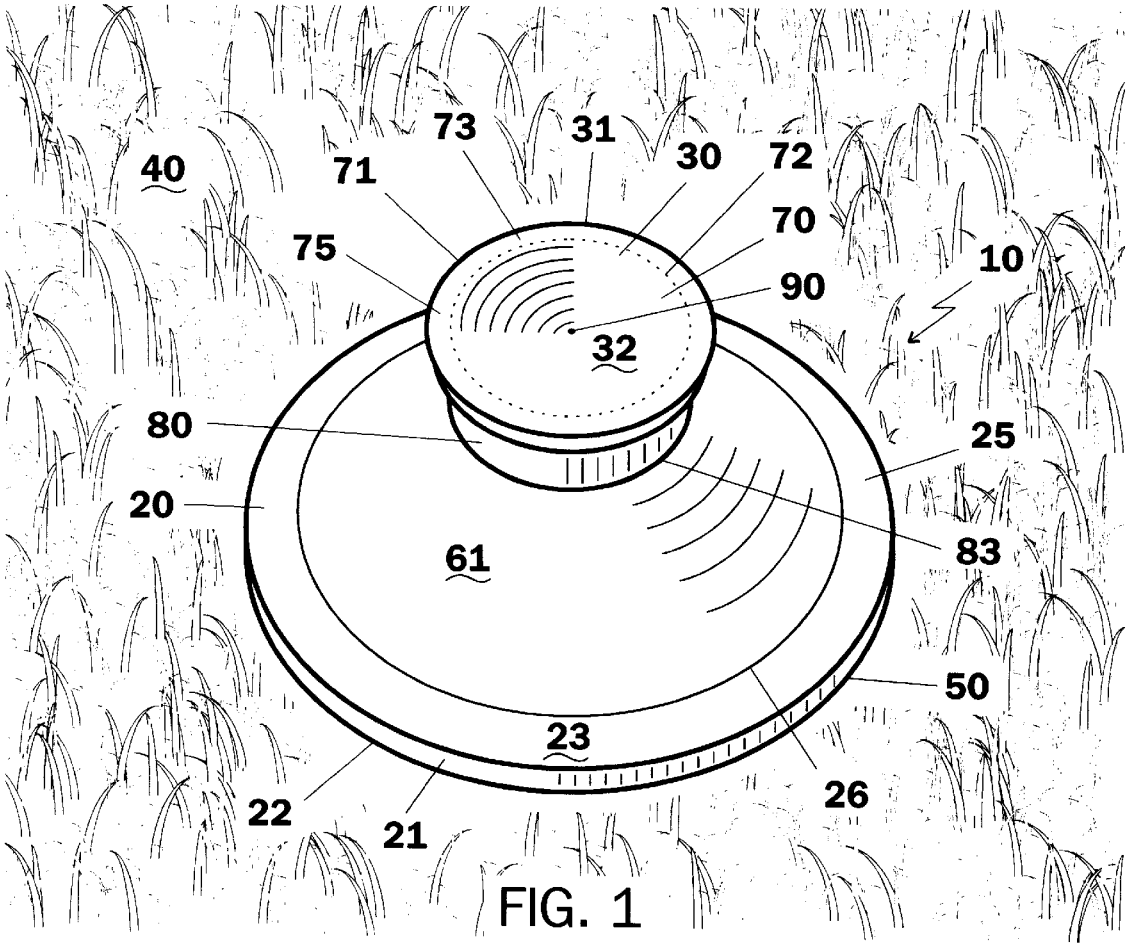
FIG. 1 is a perspective view of an embodiment of the golf tee of this invention placed on a playing surface such as a grassy tee box.

Referring now to FIG. 1, a unitary golf tee generally shown as numeral 10 is adapted to be placed upon a playing surface 40. The golf tee 10 comprises a frustoconical portion 60, a ground engaging base 20, an upper surface 30 and a centrally located ball support 70 associated with upper surface 30. Ground engaging base 20 is adapted to be greater in diameter than upper surface 30. According to the teachings of this invention, it has been found that when ground engaging base 20 is from about two to about four times, and more particularly, is about two and one half times the diameter of upper surface 30, the desired stability is achieved for a golf tee 10 which is adapted to be placed upon the playing surface 40 without penetrating it. Those skilled in the art will realize that the base may be of larger or smaller size or ratio therebetween and still function as hereinafter intended.

In the preferred embodiment shown in the figures and as best observed in FIG. 2, ground engaging base 20 has an outside diameter between one inch (1") and two and one half inches (2½") and preferably about one and one half inches (1½") at its outer periphery 21. Correspondingly, the outer peripheral surface 31 of upper surface 30 has an outside diameter between one quarter inch (¼") and three quarters inch (¾") and preferably five eighths inch (⅝"). Ball support 70 formed into and integral with upper surface 30 usually has an annular flange 73 formed between an outer circular edge 71 and a ball contact circle 72 having a junction 78 therebetween. Flange 73 is adapted to provide sufficient rigidity to ball support 70 to prevent distortion thereof when a golf ball is teed thereupon. Flange 73 has a width of approximately one sixteenth inch (1/16") and is typically an annulus 79 projecting from a top end 86 of a cylindrical wall 85 of a cylindrical portion 80, cylindrical portion 80 being centrally mounted upon frustoconical portion 60 above ground engaging base 20. Annulus 79 may be of any configuration but preferably is semicircular in cross section having a radius of about one thirty secondth inch (1/32"). In the preferred embodiments, ball contact circle 72 has a diameter of about one half inch (½") although ball contact circle 72 may be greater or smaller in diameter as is readily apparent by choosing a different diameter for outer peripheral surface 31 and/or a different width for flange 73 or configuration for a ball support surface 75 as hereinafter explained.

Flange 73 may further comprise a beveled portion 74 tapering inwardly from junction 78 to at least ball contact circle 72 providing a ball support surface 75 for a golf ball to be placed upon. Beveled portion 74 may be beveled at an angle 76 from about 15 degrees to about 20 degrees. When portion 74 is beveled at an angle 76 of approximately 17.3 degrees, ball support surface 75 theoretically contacts the outer contour of a golf ball at a ball contact circle 72 diameter of approximately one half inch (½") but the ball nestles into ball support surface 75 thereby conforming a portion of ball support surface 75 to the outer contour of the ball. When portion 74 is beveled at an angle 76 greater than about 17.3 degrees, ball contact circle 72 is greater in diameter and contacts the ball in circular line contact further toward junction 78. However, it has been found that when portion 74 is beveled at an angle 76 of about 20 degrees, ball support surface 75 contacts the outer contour of a golf ball at approximately junction 78 at a diameter of approximately thirty seven sixty fourths inch (37/64") and the outer periphery of the ball rests thereupon and the weight of the ball slightly deforms ball support surface 75 which tends to grip the ball with a slight gripping force. Similarly, it has been found that when portion 74 is beveled at an angle 76 of about 15 degrees, ball support surface 75 contacts the outer contour of a golf ball at an approximately diameter of seven sixteenths inch (7/16") and ball support surface 75 still roughly corresponds to the outer contour of a golf ball gripping it therebetween. In the preferred embodiment, portion 74 is beveled at an angle 76 of 20 degrees from the horizontal plane coincident with upper surface 30.

Flange 73 may comprise two separate surfaces, beveled ball support surface 75 and an annular planar flange surface (not shown) wherein the planar surface residues between outer peripheral surface 31 and junction 78 while beveled ball support surface 75 resides inwardly of junction 78. If the planar surface has an inside diameter of less than one half inch (½") ball contact circle 72 is defined by this new inside diameter.

Top end 86 becomes the terminating end of wall 85 having outer circular edge 71, ball contact circle 72, the planar surface (if used), beveled ball support surface 75 and junction 78 defined thereon and therearound. Alternately, flange 73 may comprise only the annular planar flange, or only beveled ball support surface 75 or only a compound curved surface from annulus 79 through junction 78 to a curved ball support surface (not shown). Thus, surface 30 may comprise a conical section formed by extending beveled ball support surface 75 inwardly thereby becoming a surface of revolution from the center 90 of tee 10 or surface 75 may be a spherical cusp of a radius equal to the radius of the ball to be supported and extending inwardly from ball contact circle 72 in a spherical surface of revolution.

In the preferred embodiments, when the diameter of outer peripheral surface 31 is one half inch (½") and flange 73 is one sixteenth inch (1/16") in width and ball contact circle 72 is one half inch (½"), a portion of the sphere of a spherical golf ball of diameter 1.680" when placed upon of ball support 70 depends into ball support 70 approximately 0.038". Similarly, when the diameter of ball contact circle 72 is approximately coincident with junction 78 and therefore approximately nine sixteenths inch (9/16"), the portion of the sphere of a spherical golf ball of diameter 1.680" depends into ball support 70 approximately 0.050". Thus the height of the ball supported by ball support 70 may be accurately calculated for each of the heights of tees 10.

In the preferred embodiments, ball support 70 is joined to frustoconical portion 60 at an upper surface plane 68 at junction 83 on outside surface 61 and at juncture 84 on inside surface 62. Juncture 84 may coincide with ball contact circle 72 and junction 83 may coincide with outer peripheral surface 31 for a golf tee 10 for use with short irons but for the preferred embodiments shown in FIGS. 1–4, junction 83 joins outside surface 61 of frustoconical portion 60 with an outer wall 82 of a cylindrical portion 80. Cylindrical portion 80 may be a solid cylinder extending above frustoconical portion 60 having ball support 70 formed in the upper surface 30 thereof. In the preferred embodiments, as shown in the figures, junction 83 on outside surface 61 and juncture 84 on inner surface 62 join frustoconical portion 60 with an inner wall 81 and outer wall 82 forming a hollow, right circular cylindrical wall 85 comprising cylindrical portion 80 which extends above upper surface plane 68 of frustoconical portion 60 terminating in ball support 70 wherein ball support 70 is spaced above upper surface plane 68 by a particular distance for each tee 10 as hereinafter described. Inner wall 81 and outer wall 82 are typically parallel whereby cylindrical wall 85 is of uniform thickness however, inner wall 81 and/or outer wall 82 may be tapered such that cylindrical wall 85 varies in thickness from top end 86 to a bottom end 87 thereof. In the preferred embodiments, cylindrical wall 85 is of uniform thickness and is from about one thirty secondth inch (1/32") to about one eighth inch (⅛")

thick and preferably is approximately one sixteenth of an inch (1/16") thick. Although in the preferred embodiments ball support 70 is spaced above upper surface plane 68, cylindrical portion 80 may be omitted whereby ball support 70 is made contiguous with and comprises upper surface plane 68.

Figure 3:
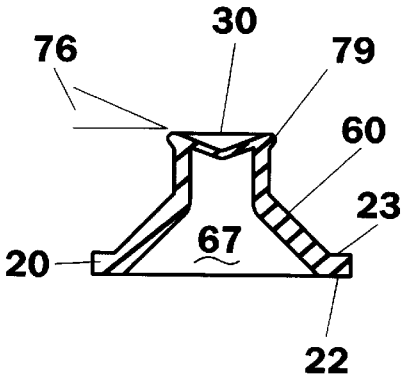
FIG. 3 is a cross section view of the preferred embodiment of a golf tee for use with short woods and long irons.
Figure 4:
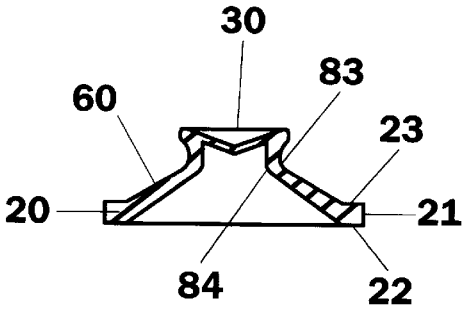
FIG. 4 is a cross section view of the preferred embodiment of a golf tee for use with short irons.

For the tee 10 shown in FIG. 2, the height of cylindrical portion 80 is from about three eighths inch (3/8") to about one half inch (1/2") and preferably approximately fifteen thirty secondths inch (15/32") inch from junction 83 on upper surface plane 68 to upper surface 30 while the height of cylindrical portion 80 in FIG. 3 is from about one eighth inch (1/8") to about three eighths inch (3/8") and preferably approximately five sixteenths inch (5/16"). Cylindrical portion 80 of tee 10 in FIG. 4 is up to about one quarter inch (1/4") and preferably approximately three sixteenths inch (3/16") in height.

Frustoconical portion 60 comprises a base plane 66, an upper surface plane 68 and tapering sides 61, 62, wherein base plane 66 is contiguous with an upper surface 23 of annular ground engaging base 20 with tapering sides 61, 62 sloping from base plane 66 to upper surface plane 68. Thus, a gradually thickening wall 63 is formed wherein outer surface 61 extends from junction 83 to a peripheral juncture 26 of base plane 66 at top surface 23 of ground engaging base 20 while inner surface 62 extends from juncture 84 to an inner peripheral juncture 27 of bottom 22 of ground engaging base 20. The innermost end 64 of wall 63 is approximately the same thickness as wall 85 while the outermost end 65 of wall 63 is approximately the same thickness as base flange 25 to be hereinafter described. The varying thickness of frustoconical portion 60 provides sufficient rigidity to frustoconical portion 60 to support a ball upon ball support 70 without undue deflection of wall 63. Although wall 63 could be of uniform thickness it has been found beneficial to provide for a tapering thickness of wall 63 to provide for a lowered cost while still providing a functional golf tee. When utilizing a rubber compound of about 55 Shore A points, the minimum thickness of wall 63 where joined with ground engaging base 20 is approximately one eighth inch (1/8") thick in order to provide for a sufficiently strong base for ball support 70. The angle of taper for each surface 61, 62 for frustoconical portion 60 also varies for each tee size in order to provide for the height of each tee 10 and to fully support ball support 70 with a ball thereupon. It has been found that the angle of taper for surfaces 61, 62 is in the range of 25 to 70 degrees, preferably with the angle of taper for surface 62 approximately 8 degrees greater than the angle of taper for surface 61 to provide for a gradually increasing thickness of wall 63 as hereinafter described.

For instance, for the tee 10 shown in FIG. 2 for use with the long wood drivers, the angle of inner surface 62 is approximately 67.5 degrees from the horizontal defined at playing surface engaging plane 50 while the angle of outer surface 61 is approximately 60 degrees from the horizontal as defined at base plane 66. Thus the vertical height of frustoconical portion 60 in FIG. 2, as measured perpendicular to playing surface engaging plane 50, from base plane 66 to upper surface plane 68, that is, from top 23 of flange 25 to junction 83 is approximately forty one sixty fourths inch (41/64"). Similarly, for the tee 10 shown in FIG. 3 for use with the short woods and long irons, the angle of inner surface 62 is approximately 53 degrees from the horizontal while the angle of outer surface 61 is approximately 45 degrees from the horizontal and the vertical height is approximately three eighths inch (3/8"). Finally, for the tee 10 shown in FIG. 4 for use with the short irons, the angle of inner surface 62 is approximately 40 degrees from the horizontal while the angle of outer surface 61 is approximately 32 degrees from the horizontal and therefore, the vertical height of frustoconical portion 60 of tee 10 in FIG. 4 is approximately fifteen sixty fourths inch (15/64").

Ground engaging base 20 has a bottom 22, bottom 22 being planar in contour and coincident with a playing surface engaging plane 50. Bottom 22 is adapted to be placed upon playing surface 40 and nestled thereonto where playing surface engaging plane 50 is contiguous with playing surface 40 to provide a stable platform for teeing a golf ball. Ground engaging base 20 has a top 23 coincident with base plane 66 of frustoconical portion 60 which may be any shape but in the preferred embodiment is planar and parallel to bottom 22. Top 23 is spaced from bottom 22 by a distance 28 equal to the height of a right circular peripheral wall 29 defined by peripheral edge 21. In the preferred embodiments, distance 28 is up to one quarter inch (1/4") but preferably is approximately one eighth inch (1/8"). Top 23, bottom 22 and outer peripheral edge 21 define the three external surfaces of a base flange 25 and wherein base flange 25 substantially defines ground engaging base 20. Top 23 is up to one quarter inch (1/4") but preferably is approximately one eighth inch (1/8") in width from outer peripheral edge 21 to peripheral juncture 26 and therefore for the preferred embodiment, the outside diameter of peripheral juncture 26 is approximately one and one quarter inch (1 1/4"). Bottom 22 is generally wider than top 23 from outer periphery 21 to juncture 27 as wall 63 tapers in thickness hereinafter described. The width of bottom 22 varies according to the angle of inner surface 62 as will become hereinafter apparent. As hereinbefore described, peripheral juncture 26 joins top 23 and juncture 27 joins bottom 22 of base flange 25 to frustoconical portion 60 and hence forms a base of frustoconical portion 60 at base plane 66. Since bottom 22 is parallel to top 23 and spaced therefrom and joined by right circular peripheral wall 29, ground engaging base 20 is substantially a circular ring surrounding frustoconical portion 60 approximately one and one half inches (1 1/2") in diameter at outer periphery 21.

Since base flange 25 is of uniform thickness and is joined to wall 63 of frustoconical portion 60 at base plane 66, wall 63 is substantially the same thickness as base flange 25 as measured between juncture 27 and peripheral juncture 26. Wall 63 then tapers in thickness from base plane 66 to innermost end 64 as inner surface 62 is disposed at an angle form the horizontal greater than the angle outer surface 61 is disposed from the horizontal. The thickness of wall 63 at base plane 66 may be up to one quarter inch (1/4") but preferably is about one eighth inch (1/8") and the thickness at innermost end 64 is up to one eighth inch (1/8") but preferably is about one sixteenth inch (1/16"). Wall 85 of cylindrical portion 80 is approximately the same thickness as the thickness of wall 63 at innermost end 64, that is about one sixteenth inch (1/16"). Upper surface 23 of base flange 26 is adapted to be used to emboss, print or mold raised legends thereupon. Similarly, outer surface 61 may be utilized for advertising slogans, company names and company logos.

It can be shown that the height of frustoconical portion 60 of the long tee 10 of FIG. 2 is approximately forty one sixty fourths inch (41/64") when the free length of cylindrical portion 80 is approximately fifteen thirty secondths inch (15/32") and the thickness of base flange 25 is approximately one eighth inch (1/8"). Thus the height of the tee 10 shown in FIG. 2 is approximately one and one quarter inch (1 1/4"). With flange 73 projecting from wall 85 approximately one sixteenth inch, beveled ball support surface 75 beveled at an angle of 20 degrees and ball contact circle 72 having a diameter of thirty seven sixty fourths inch (37/64"), the center of a golf ball seated upon tee 10 of FIG. 2 is at a height of approximately two inches (2") above playing surface 40 for driving with one of the long woods from the tee box. In like manner, it can be shown that the height of frustoconical portion 60 of the intermediate tee 10 of FIG. 3 is approximately three eighths inch (3/8") when the free length of cylindrical portion 80 is approximately five sixteenths inch (5/16") and the thickness of base flange 25 is one eighth inch (1/8"). Thus the height of the tee 10 shown in FIG. 3 is approximately thirteen sixteenths inch (13/16"). With flange 73 projecting from wall 85 approximately one sixteenth inch, beveled ball support surface 75 beveled at an angle of 17.3 degrees and ball contact circle 72 having a diameter of one half inch (1/2"), the center of a golf ball seated upon tee 10 of FIG. 3 is at a height of one and five eighths inch (1 5/8") above playing surface 40 for driving with one of the short woods or one of the long irons from the tee box. Finally, it can be shown that as the height of frustoconical portion 60 of the short tee 10 of FIG. 4 is approximately fifteen sixty fourths inch (15/64") when the free length of cylindrical portion 80 is approximately three sixteenths inch (3/16") in height and the thickness of base flange 25 is one eighth inch (1/8"). Therefore, the height of the tee 10 shown in FIG. 4 is approximately one half inch (1/2"). With flange 73 projecting from wall 85 approximately one sixteenth inch, beveled ball support surface 75 beveled at an angle of 20 degrees and ball contact circle 72 having a diameter of thirty seven sixty fourths inch (37/64"), the center of a golf ball seated upon tee 10 of FIG. 4 is at a height of one and three eighths inch (1 3/8") above playing surface 40 for driving with one of the short irons from the tee box. Those skilled in the art will fully appreciate that upper surface 30, upper surface plane 68, base plane 66 and playing surface engaging plane 50 are all parallel and ball support 70 is contiguous with and comprises upper surface 30 thereby ball support 70 is adapted to always be parallel to playing surface 40.

Each of the tees 10 of FIGS. 2–4 are adapted to be inverted by forcing upper surface 30 downwardly into frustoconical portion 60 such that a tee 10' of a different height may be established. For instance, as shown in FIG. 5, tee 10 of FIG. 2 has been inverted to produce tee 10'. When inverted, tee 10' has parts corresponding to tee 10 of FIG. 2 however these parts appear on different surfaces as hereinafter described.

Referring to FIG. 5, base flange 25 presents outer peripheral edge 21 to playing surface engaging plane 50 while bottom 22 becomes outer peripheral edge 21'. Therefore outer peripheral edge 21 becomes bottom 22' and top 23 becomes the bottom portion of inner surface 62' while inner surface 62 becomes outer surface 61'. Similarly, innermost end 64 becomes flange 73' of new upper surface 30' of ball support 70'. Flange 73' is also generally semicircular in cross section and when a ball is seated upon ball support 70', the weight of the ball slightly depresses a portion of the generally semicircular flange 73' thereby slightly gripping the ball on flange 73'. As is readily observed in FIG. 5, outer surface 61' and inner surface 62' are now curvilinear surfaces and are generally concave from innermost end 64' to juncture 27' and peripheral juncture 26' to junction 83'. Junction 83' defines new outer peripheral surface 31' of flange 73'. Since flange 73' is now formed from a portion of inner wall 81, ball support surface 75 is no longer presented to the ball. As cylindrical portion 80 has been depressed into frustoconical portion 60, it depends into the hollow portion 67' now formed within new tee 10' and therefore forms no part of ball support 70'. It has been found that when tee 10 of FIG. 2 is inverted to produce new tee 10', the vertical height of tee 10', as measured between upper surface 30' and playing surface engaging plane 50 and perpendicular to playing surface engaging plane 50, is approximately seven eighths inch (7/8") and a ball teed upon ball support 70' has its center approximately one and three quarters inch (1 3/4") inches from playing surface engaging plane 50. Similarly, when tee 10 of FIG. 3 is inverted to produce new tee 10', the vertical height of tee 10', as measured perpendicular to playing surface engaging plane 50, is approximately five eighths inch (5/8") and a ball teed upon ball support 70' has its center approximately one and one half inch (1 1/2") from playing surface engaging plane 50. Finally, when tee 10 of FIG. 4 is inverted to produce new tee 10', the vertical height of tee 10' is slightly less than tee 10 of FIG. 4 and is therefore approximately three eighths inch (3/8") and a ball teed upon ball support 70' has its center approximately one and one quarter inch (1 1/4") inches from playing surface engaging plane 50. By inverting tee 10 of each of the FIGS. 2–4, a total of six tee heights may be achieved with three separate tees 10. Of course, it is possible to manufacture other tee heights having differing lengths of either cylindrical portion 80, frustoconical portion 60 or both to achieve any tee height desired by the golfer without departing from the scope of the appended claims.

Golf tee 10 is preferably made of an elastomeric material and more particularly is made of rubber which is a compounded thermosetting elastomer selected from the group comprising natural rubber, polyisoprene, polyurethane, styrene-butadiene rubber, silicone, nitrile, ethylene-propylene diene, butyl, vinyl or blends of the above. Additionally, golf tee 10 may be constructed of more rigid polymers such as polyethylene, polypropylene, polycarbonate, polyvinylchloride, ABS or blends of the above. Most preferably, golf tee 10 is made from a compounded thermosetting nitrile rubber elastomer having a Shore A hardness between 45 and 65 and more particularly from 52 to 58 Shore A durometer points. It has been found that a nitrile rubber golf tee 10 having a 55 Shore A durometer provides the best balance of flexibility, support for a golf ball, durability in the game of golf and least costly. Of course, golf tee 10 may be made of other materials, such as recycled organic material, wood, papier-maché, cardboard or the like without departing from the scope of this invention.

The elastomeric material comprising golf tee 10 preferably contains pigmentation contrasting with playing surface 40. The pigmentation is fully incorporated into the elastomeric material and is retained therein to prevent discoloration of a golf club face when a tee 10 and a ball supported thereon is struck with a golf club head. Furthermore, each tee 10 should be of contrasting color in order to readily distinguish one from the other. In particular, a golf tee 10 of FIG. 2 is preferably dark blue, the golf tee 10 of FIG. 3 is white and the golf tee 10 of FIG. 4 is red. These colors are already widely used on golf courses to indicate a course playing length where the professional tee boxes are typically marked in dark blue while the mens tees are white and the ladies tees are red. It can be readily appreciated here that the tees of blue, white and red may therefore give a ready reference to the length of the corresponding drive in the same color combination used for the course lengths. Of course, other colors and color combinations are possible but the preferred colors are readily distinguishable from an outdoor playing surface 40 such as grass and from an indoor playing surface 40 such as carpet. As the golf tee 10 is made of a durable elastomer and is readily distinguishable from playing surface 40, it is readily apparent that golfers will replace the standard wooden or thermoplastic tee with the tee 10 of this invention and will therefore retrieve each tee 10 when used providing for an ecologically sound golf game.

As a golfer prepares to tee off from a tee box, a golf tee 10 is selected in combination with the proper club for the distance of the drive. Golf tee 10 is then placed upon playing surface 40 and rotated back and forth to nestle any uneven material into hollow portion 67 of frustoconical portion 60 such that bottom 22 of ground engaging base 20 is seated firmly upon the base of playing surface 40. The ball to be teed off is placed on ball support 70 and the ball is addressed in the usual manner. When the ball is struck with the club, tee 10 is most likely also struck and may be driven in the same direction as the ball. However, since tee 10 is relatively light in weight it travels but a short distance and may not move at all. Furthermore, since tee 10 is made of rubber, it may in fact, travel in a direction directly opposite that of the ball as the resilient rubber compound will rebound when struck with the club. Since right circular wall 29 opposite the surface of the ball being struck will frictionally engage playing surface 40, it is believed that tee 10 will deflect, and when the striking motion is finished, may rebound opposite the direction struck and thus be easily retrieved by the golfer. The retrieved tee 10 may then be placed into a suitable receptacle for use at another tee box to raise the ball the exact same distance from playing surface 40 as previously done.

In a method of making a golf tee 10 as shown in the figures, a frustoconical portion 60 is formed having an upper surface plane 68 and a base plane 66. A ground engaging base 20 is formed contiguous with base plane 66, ground engaging base 20 comprising a base flange 25 having a top 23, a bottom 22 and a right circular wall 29 joining top 23 and bottom 22. A right circular cylinder 80 is formed contiguous with and extending upwardly from upper surface plane 68 having an upper surface 30 and a centrally located ball support 70 associated with upper surface 30. Ground engaging base 20 is formed two to about four times greater in diameter than upper surface 30. Ball support 70 is formed into and integral with upper surface 30 and usually has an outer circular edge 71 and an ball contact circle 72 having flange 73 formed therebetween. Flange 73 may further have a beveled portion 74 formed thereon tapering inwardly from outer circular edge 71 to at least ball contact circle 72 providing a ball support surface 75 for a golf ball to be placed upon. Beveled portion 74 may be beveled from about 15 degrees to about 25 degrees but is most particularly formed to be 20 degrees from the horizontal. Flange 73 may comprise two separate surfaces having a beveled ball support surface 75 and annular planar flange surface (not shown) formed thereon wherein the planar surface is formed between outer peripheral surface 31 and junction 78. Junction 78 defines the transition point between flange 73 and ball support surface 75 and therefore beveled ball support surface 75 is formed inwardly of junction 78. Ball contact circle 72 is generally approximately one half inch (½") in diameter however, if the planar surface has an inside diameter of less than one half inch (½") ball contact circle 72 is defined by this new inside diameter. Top end 86 becomes the terminating end of wall 85 having outer circular edge 71, ball contact circle 72, the planar surface (if used), beveled ball support surface 75 and junction 78 defined thereon and therearound. Alternately, flange 73 may comprise only the annular planar flange, or only beveled ball support surface 75 as shown, or only a compound curved surface from annulus 79 through junction 78 to a curved ball support surface (not shown) or a combination of any or all of these. A gradually thickening wall 63 is then formed wherein outer surface 61 extends from junction 83 to a peripheral juncture 26 of base plane 66 at top surface 23 of ground engaging base 20 while inner surface 62 extends from juncture 84 to juncture 27 of bottom 22 of ground engaging base 20. The innermost end 64 of wall 63 is approximately the same thickness as wall 85 while the outermost end 65 of wall 63 is approximately the same thickness as ground engaging base 20.

While tee 10 may be made in the separate parts as generally described above, it is usual and customary to form tee 10 as a single unit by simultaneously making all parts. Thus tee 10 may be cut from a round bar of stock forming the various surfaces by a machining operation. For instance, tee 10 could be cut from a round bar of material such as wood, rubber or thermoplastic but tee 10 is best made by molding same in a compression mold, an injection mold or transfer mold operation. In the injection or transfer molding operation, the parts of tee 10 are formed simultaneously from a quantity of rubber heated to a proper temperature and forced through a small orifice such as the gate the mold. The thermosetting rubber compound vulcanizes rapidly due to the heat generated during the injecting process and numerous sets of tees 10 may be made in a relatively short period thereby making the cost of each relatively low. Of course, a thermoplastic material may also be utilized to injection mold tees 10 but a rubber compound having suitable pigment fully incorporated therein is preferred. In this manner, tees 10 having contrasting color to playing surface 40 are made.

The mold for the molding of tees 10 is made in two halves, a first half having a plurality of cavities, each cavity defining upper surface 30 with a reverse image of planar flange (when used), beveled surface 74, flange 73 and inwardly projecting surface 32 machined into a recess in the mold, surface 30 at a depth equal to the overall height of tee 10. Outer peripheral surface 31 of upper surface 30 and outer wall 82 of cylindrical portion 80 define the right circular recess depending into the mold terminating at upper surface 30. Tapering from an end of the right circular recess which forms junction 83 on tee 10, an additional part of the molding recess is formed which forms outer surface 61. Finally, a flat recess is machined into the first half of the mold which defines top 23 and right circular wall 29 of base flange 25. Thus, the recess formed in the first half of the mold defines all the exterior surfaces of tee 10 as the parting line for the mold halves is contiguous with bottom 22 of base flange 25 forming bottom 22 with a flat face comprising the support for a mating half of the mold.

All of the interior surfaces of tee 10 are formed on a mating half of the mold. For instance, the outermost part of the mating half defines the inner surface of inwardly projecting surface 32, inner wall 81 of cylindrical portion 80 and inner surface 62 of frustoconical portion 60.

The mating halves of a compression mold are placed in a suitable heated press, separated, and a sheet of unvulcanized rubber compound placed on the half having the cavities machined therein. The mating half of the mold is then lowered onto the sheet of rubber and the press closed. The pressure of the ram of the press then causes the rubber compound to flow into all the cavities forming the multiplicity of tees 10. When the rubber compound is vulcanized, the press is opened and the mating half of the mold removed. A sheet containing all the formed tees 10 is then stripped from the first half of the mold by grabbing one end or edge and pulling the sheet from the mold. Tees 10 are then die cut from the sheet, deflashed if necessary, and packaged for shipment.

In an injection or transfer molding operation, the mating half may also carry the injection port for forcing the rubber to be molded into the cavity formed between the mating halves when same are mated together at the common parting line all as well known in the art of injection molding of rubber. In like manner, the mating half may also carry an injector pin for removal of the part from the mold and the cylindrical portion of the mating half of the mold which forms cylindrical portion 80 may be made to provide for a dual function of accepting the injection port and ejecting the part from the mold. The multiple cavities in the mating halves provide for the making of multiple tees 10 of the same size simultaneously or may be ported to provide for manufacture of multiple tees 10 of different size and of the multiple colors. Tees 10 are then deflashed if necessary, and packaged for shipment.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. In a unitary, hollow golf tee adapted to be placed upon a playing surface, said golf tee comprising a frustoconical portion, a first playing surface engaging base, a first upper surface and a first centrally located ball support associated with said first upper surface wherein said first playing surface engaging base is greater in diameter than said first upper surface, said first upper surface spaced from said first playing surface engaging base a first distance, the improvement wherein said ball support is depressed downwardly into said hollow tee, said tee thereby becoming inverted to provide a second playing surface engaging base, a second upper surface and a second centrally located ball support associated with said second upper surface wherein said second playing surface engaging base is greater in diameter than said second upper surface, said first upper surface and second upper surface spaced from said second playing surface engaging base.

2. A unitary, hollow golf tee as in claim 1 wherein said second upper surface is spaced from said second playing surface engaging base a second distance, said second distance less than said first distance.

3. A unitary, hollow golf tee as in claim 2 wherein said second distance is from about one-fourth to about one third less than said first distance.

4. A golf tee as in claim 1 wherein said first upper surface is spaced from said second playing surface engaging base inwardly of said second playing surface engaging base.

5. In a set of golf tees for use upon a playing surface in combination with a ball to be supported by one of said golf tees, each said golf tee comprising a frustoconical portion, a first playing surface engaging base, a first upper surface and a first centrally located ball support associated with said first upper surface, said frustoconical portion having a base plane, an upper surface plane and tapering sides, said first playing surface engaging base being greater in diameter than said first upper surface, each said golf tee of said set of golf tees having said first upper surface spaced from said first playing surface engaging base by a different distance, the improvement wherein when each said golf tee is inverted by depressing said first ball support downwardly into said hollow tee, each said tee thereby becoming inverted to provide a second playing surface engaging base, a second upper surface and a second centrally located ball support associated with said second upper surface wherein said second playing surface engaging base is greater in diameter than said second upper surface, said first upper surface and second upper surface spaced from said second playing surface engaging base.

6. A set of golf tees as in claim 5 wherein each said tee of said set of golf tees is formed from a flexible elastomeric material having a different pigmentation fully incorporated into said flexible elastomeric material and retained therein to prevent discoloration of a golf club face when said tee and a ball supported on said tee are struck with said golf club face of a golf club head.

7. A set of golf tees as in claim 6 wherein said pigmentation of each said tee of said set of golf tees contrasts with said playing surface.

8. A set of golf tees as in claim 6 wherein said pigmentation of one said tee of said set of golf tees is red.

9. A set of golf tees as in claim 6 wherein said pigmentation of one said tee of said set of golf tees is blue.

10. A set of golf tees as in claim 6 wherein said pigmentation of one said tee of said set of golf tees is white.

11. A set of golf tees as in claim 5 wherein said set of golf tees comprises three tees.

12. A set of golf tees as in claim 5 wherein said first upper surface is spaced from said first playing surface engaging base a first distance.

13. A set of golf tees as in claim 12 wherein said second upper surface is spaced from said second playing surface engaging base a second distance, said second distance less than said first distance.

14. A set of golf tees as in claim 5 wherein said first upper surface is spaced from said second playing surface engaging base inwardly of said second playing surface engaging base.

15. A unitary, hollow golf tee as in claim 13 wherein said second distance is from about one-fourth to about one third less than said first distance.

* * * * *